United States Patent [19]

Petrohilos

[11] Patent Number: 5,014,952

[45] Date of Patent: May 14, 1991

[54] SHELF SUPPORT CLIP

[75] Inventor: Dimitri Petrohilos, London, England

[73] Assignee: Adestia Corporation, Norfolk, Va.

[21] Appl. No.: 475,739

[22] Filed: Feb. 6, 1990

[51] Int. Cl.[5] ..... A47B 57/30

[52] U.S. Cl. ..... 248/250; 248/243; 108/108

[58] Field of Search ..... 248/125, 218.4, 239, 248/243, 247, 248, 250; 108/106, 107, 108; 211/90, 187

[56] References Cited

U.S. PATENT DOCUMENTS

| | | | |
|---|---|---|---|
| 1,504,523 | 8/1924 | Sheren | 248/243 |
| 2,261,078 | 10/1941 | Shockey | 248/250 |
| 3,279,876 | 10/1966 | Cyr | 108/107 |
| 3,649,059 | 3/1972 | Davidson | 248/239 |
| 4,037,813 | 7/1977 | Loud et al. | 248/250 |
| 4,541,600 | 9/1985 | Vieglins | 248/239 |
| 4,830,323 | 5/1989 | Harley | 248/250 |

FOREIGN PATENT DOCUMENTS

| | | | |
|---|---|---|---|
| 309063 | 10/1955 | Switzerland | 211/187 |
| 781778 | 8/1957 | United Kingdom | 248/243 |

*Primary Examiner*—Alvin C. Chin-Shue
*Assistant Examiner*—Robert A. Olson
*Attorney, Agent, or Firm*—Kalish & Gilster

[57] ABSTRACT

A one-piece clip simultaneously supports and grips a shelf when the clip is secured between a support pole and the shelf edge by a screw which penetrates the pole, the clip and the shelf consecutively. The longitudinal clip is die-cut and has a central base portion which abuts an indentation in the pole. An aperture centered in the clip base portion is aligned with screw holes horizontally penetrating the pole prior to insertion of the screw. Parallel arms extend up from the base portion of the clip, elbows attached thereto connect angled arms which extend outwardly and terminate in clip ends which flushly abut the exterior surface of the support pole.

11 Claims, 1 Drawing Sheet

FIG. 1
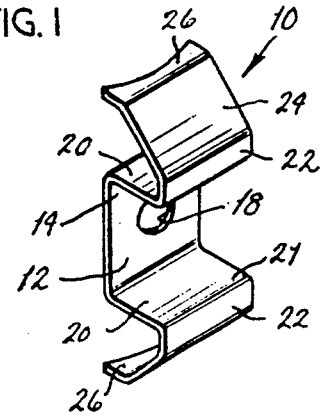
FIG. 3
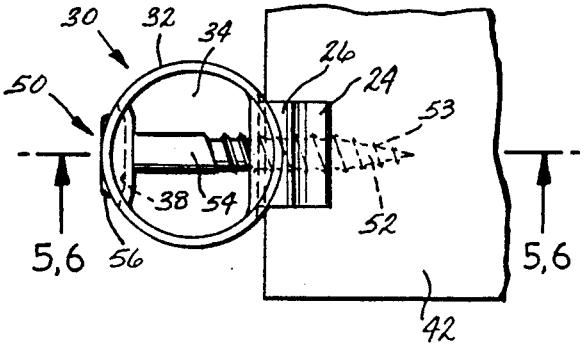
FIG. 2
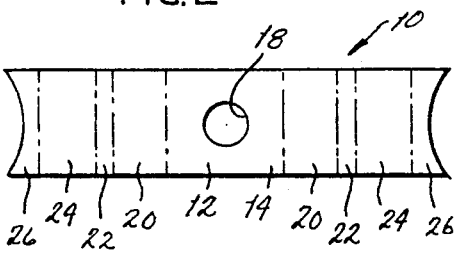
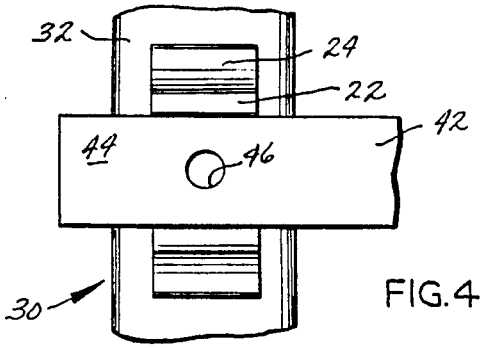
FIG. 4
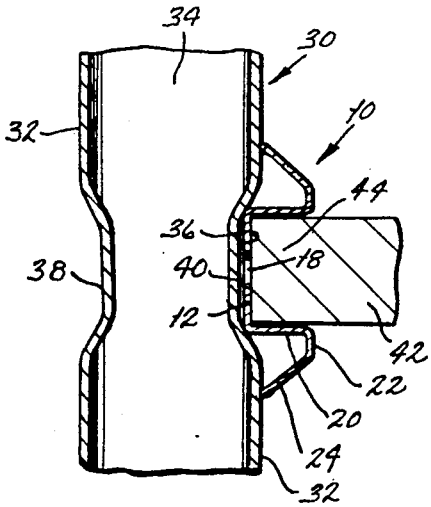
FIG. 5
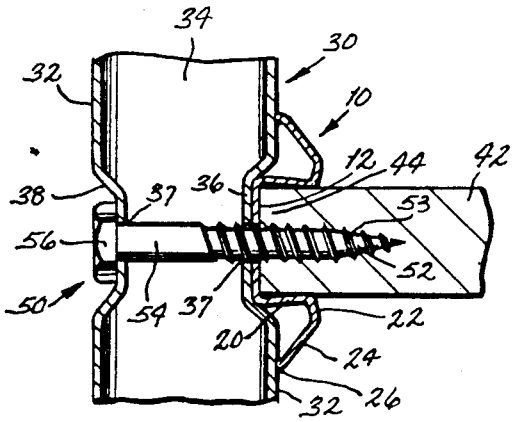
FIG. 6

SHELF SUPPORT CLIP

BACKGROUND AND SUMMARY OF THE INVENTION

This invention relates generally to the field of component furniture and, more particularly, to a clip for mounting a shelf on a support pole.

Heretofore, various devices have been known for mounting shelves on walls or other supporting structures, such as poles, rods or the like. U.S. Pat. No. 4,037,813 to Loui et al discloses a one-piece plastic shelf support member comprised of an upper shoulder portion, a central portion having a gripping rib 26 and a lower flange portion for supporting a shelf. A shaft 16 which extends from the lower portion into a bore in a support board provides the only attachment, i.e., by friction, of the support device to the upright support member. The construction of the Loui et al shelf support imposes the restriction that the clip or support can only be used in one vertical direction, that is, it cannot be inverted or turned upside down and used equally as well, as is the case with the present shelf support clip. Furthermore, the Loui et al shelf support requires gussets 28 to withstand an increased shelf load; such is not the case with the new shelf support clip which independently provides sufficient support.

U.S. Pat. No. 4,541,600 to Vieglins teaches a shelf bracket made of a solid, yet elastically deformable material and having a through-hole for a screw and a transverse channel for holding the end edge of a shelf. Full insertion of the screw permits a clamping action to occur between the channel, or groove, and the shelf. Engagement of the Vieglins bracket with the upright support thereof is limited to the marginal portions 9 of the bracket. By contrast, the new die-cut shelf support clip permits full contact of the base portion as well as the end portions, with the support pole when properly attached thereto.

Conventional forms of attachment, such as simply screwing or nailing a shelf directly to a support pole suffer from the disadvantage that the shelf may tilt and cause the wood or other material thereof to split under the resultant force. Other known methods, such as supporting the shelf from beneath by slats which connect side poles, suffer from the disadvantage that they require more materials and thus are heavier, awkward to handle and more expensive. Furthermore, problems may be created in moving known shelving units because the shelves may be permanently attached to the support structures or at least be very difficult to disassemble. The inability to easily take apart a shelving unit also yields the disadvantage that the shelves cannot be selectably adjusted to other than the predetermined height.

Therefore, it is an object of the present invention to provide a clip for supporting a shelf on a support pole in such manner that the shelf is securely and stably maintained thereon by attaching with a single screw which penetrates both the pole and the shelf.

It is another object of the present invention to provide a shelf support clip having the features stated that permits the shelving unit to have shelves of a variable height, which height may be easily, selectably altered.

It is a further object of the present invention to provide a clip having the features stated which permits a shelving unit constructed therewith to be easily dissembled for shipping and/or storage.

It is a still further object of the present invention to provide a clip having the features stated which is inexpensive and relatively lightweight, such a clip being capable of use for assembling, for example, free-standing bookshelves, a movable cart or other component furniture.

It is yet another object of the present invention to provide a clip having the features stated which simultaneously supports and grips a shelf positioned therein.

It is still another object of the present invention to provide a clip having the features stated which is constructed in one piece, which may be manufactured in various sizes and which comprises clip ends adapted to fit snugly against a corresponding shelf support pole.

Briefly, in furtherance of the above objects, the present invention comprises a one-piece shelf support clip having a flat base portion centrally penetrated by an aperture and having first and second opposing ends. The aperture and the first and second opposing base ends create a plane. First and second opposing, parallel walls extend respectively from the first and second base ends and have outer ends. First and second elbow portions extend outwardly relative to the base portion and respectively from the outer ends of the first and second opposing parallel walls at substantially right angles thereto. First and second outwardly angled arms project respectively from the first and second elbow portions, away from the first and second opposing parallel walls, toward the plane created by the base portion and have detached ends. First and second parallel clip ends project respectively from the detached ends of the first and second angled arms and through the plane created by the base portion.

Other objects and features will be in part apparent and in part pointed out hereinbelow.

BRIEF DESCRIPTION OF THE DRAWINGS

FIG. 1 is a perspective view of a shelf clip constructed in accordance with and embodying the present invention.

FIG. 2 is a plan view of the die cut shelf clip embodied in FIG. 1 prior to stamping into the functional shape thereof.

FIG. 3 is a plan view of the clip of FIG. 1 positioned securing a shelf to a support pole.

FIG. 4 is a shelf end view of the clip of FIG. 1 in positioned as in FIG. 3.

FIG. 5 is a vertical sectional view taken on line 5 of FIG. 3, to insertion of the screw.

FIG. 6 is a vertical sectional view taken on line 6—6 of FIG. 3.

DESCRIPTION OF THE PREFERRED EMBODIMENT

Referring now by reference characters to the drawings, shown in FIG. 1 is the shelf support or mounting clip of the present invention, generally designated 10, as stamped from a single, flat, die-cut blank (FIG. 2). Shelf clip 10 is longitudinal in nature and is bifurcated by a central base portion 12 creating mirror images of each half of clip 10. Base portion 12 has a central aperture 18 and opposing first and second ends 14 by which it is connected respectively to first and second parallel opposing walls 20; which walls 20 terminate in corresponding first and second wall ends 21 and turn outwardly away from base portion 12 to form first and second elbows 22. First and second angled arms 24 extend respectively from first and second elbows 22 outwardly from walls 20 and toward an imaginary plane formed by base 12. Angled arms 24 terminate in identical first and second clip ends 26 formed parallel to each other as well as to walls 20, toward and perpendicular to the plane formed by base 12. Shelf clip ends 26 are shown concave (FIGS. 1 and 2) for snug abutment with a vertically positioned shelf support pole 30 having a convex outer surface 32 (FIG. 3).

Pole 30, which preferably comprises a convex, exterior surface 32 which defines a hollow core 34, may, alternatively, be of a square or rectangular tube-like or solid construction; in which case clip ends 26 must be straight for flush abutment thereto. Pairs of opposing outer indentations 38 and inner indentations 36 spaced at approximately 2 inch intervals along the length of pole 30 (FIGS. 5, 6) are each penetrated centrally by opposing screw holes 37 (FIG. 6).

In use, a shelf 42 is placed horizontally so that the shelf end 44 may be slidingly introduced into a seated position between shelf clip walls 20. Shelf 42 is preferably of particle board laminated with either wood veneer or plastic, such as MELAMITE. Conceivably, solid wood, metal or plastic could also be used to construct shelf 42. Clip 10 with shelf 42 in place is positioned against inner indentation 36 of tube 30. When clip 10 is so positioned, a space 40 remains between clip base 12 and exterior surface 32 of pole 30 at inner indentation 36 (FIG. 5). In this position, opposing screw holes 37 of pole 30 are in alignment with aperture 18 of shelf clip 10 as well as with a preferably pre-drilled screw hole 46 in shelf end 44 (FIG. 4). Thus, a screw 50 may be inserted through pole 30, through clip 10 and into shelf 42. Screw end 52 is provided with conventional threads 53 in order to bite into shelf end 44. Screw 50 is preferably of the conformant type having, consecutively, an Allen head 56, a shank portion 54 and threaded end 52 (FIG. 6), although other known screws will function acceptably. As screw 50 is tightened, it pulls shelf end 44 against clip base 12 and thereby forces base 12 against inner indentation 36. This action causes clip ends 26 to flex outwardly, thus applying force via angled arms 24 to elbow portions 22, and thereby forcing elbows 22 grippingly against shelf end 44.

It is readily seen that clip 10 may be manufactured in a variety of sizes, for use with shelves 42 of any ordinary, commercially available thickness. The shape of clip ends 26 may also be adapted as required by the contour of outer surface 32 of pole 30, as previously described. Accordingly, use of a properly fitting clip 10 at each corner of shelf 42 will provide a very firm, stable surface for a shelf, cart, or the like. This is particularly true because shelf 42 is secured in three ways: (1) penetration by screw 50, (2) sandwiching between clip walls 20 to provide support and prevent twisting, and (3) gripping between elbows 22 to prevent sliding of shelf 42. Moreover, use of clip 10 for mounting, requiring only one screw per clip, minimizes the time, tools and skill necessary for dissembly and reconstruction of the shelving unit. Likewise, the pure simplicity of construction of clip 10 permits economical manufacture thereof and thus minimizes the cost of any item produced therewith.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A one-piece shelf support clip formed from a flat blank; said shelf support clip comprising a base portion centrally penetrated by an aperture and having first and second opposing ends, said aperture and said first and second opposing base ends creating a plane; wall means extending from said first and second base ends and having outer ends; elbow portions extending outwardly relative to said base portion and respectively from the outer ends of said wall means and outwardly angled arms projecting from said elbow portions, away from said wall means, toward the plane created by said base portion and having detached ends; and clip ends projecting from the detached ends of said outwardly angled arms and through the plane created by said base portion.

2. A one-piece shelf support clip formed from a flat, blank; said shelf support clip comprising a flat base portion centrally penetrated by an aperture and having first and second opposing ends, said aperture and said first and second opposing base ends creating a plane; first and second opposing, parallel walls extending respectively from said first and second base ends and having outer ends; first and second elbow portions extending outwardly relative to said base portion and respectively from the outer ends of said first and second opposing parallel walls at substantially right angles thereto; first and second outwardly angled arms projecting respectively from said first and second elbow portions, away from said first and second opposing parallel walls, toward the plane created by said base portion and having detached ends; and first and second parallel clip ends projecting respectively from the detached ends of said first and second outwardly angled arms and through the plane created by said base portion.

3. A one-piece shelf support clip as recited in claim 2, wherein said clip is comprised of metal.

4. A one-piece shelf support clip as recited in claim 2, wherein said clip is provided with a longitudinal axis and said first and second clip ends are straight and perpendicular to the longitudinal axis of said clip.

5. A one-piece shelf support clip as recited in claim 2, wherein said first and second clip ends are concave.

6. The combination of a shelf support pole having a longitudinal axis and an exterior surface comprising a plurality of spaced, paired, inner and outer indentations centrally pierced by opposed screw holes, and a one-piece shelf support clip having a longitudinal axis and comprising: a flat base portion centrally penetrated by an aperture and having first and second opposing ends, said aperture and said first and second opposing base ends creating a plane, said aperture being in alignment with a corresponding pair of said support pole opposed screw holes when said base portion is seated adjacent to any one of said inner opposed indentations of said shelf support pole; first and second opposing, parallel walls extending respectively from said first and second base ends and having outer ends positioned outwardly in relation to said shelf support pole and perpendicular relative to the longitudinal axis thereof; first and second elbow portions extending outwardly relative to said base portion and respectively from the outer ends of said first and second opposing parallel walls at substantially right angles thereto and substantially parallel to the longitudinal axis of said shelf support pole; first and second outwardly angled arms projecting from said respective first and second elbows and away from said first and second opposing parallel walls, toward the plane created by said base portion and having detached ends and toward the longitudinal axis of said shelf support pole; and first and second parallel clip ends projecting respectively from the detached ends of said first and second angled arms and through the plane created by said base portion and flushly abutting the exterior surface of said shelf support pole; whereby, insertion of a screw through said respective pair of opposed support pole screw holes, through said clip base portion aperture, into a shelf edge and tightening of the screw will provide pressure via the shelf edge against and to force said clip base portion tightly against said support pole respective inner indentation, thereby causing outward force to be applied to said first and second parallel clip ends at the respective points of abutment against the support pole exterior surface, the force being transferred via said first and second angled arms to push said corresponding first and second clip elbows grippingly against the shelf edge.

7. The combination as recited in claim 6, wherein said shelf support pole exterior surface is convex and said first and second clip ends are concave for flush abutment with said shelf support pole convex outer surface.

8. The combination as recited in claim 6, wherein said shelf support pole exterior surface is flat and said first and second clip ends are straight for flush abutment with said shelf support pole flat outer surface.

9. The combination as recited in claim 6, wherein said shelf support pole and said clip are comprised of metal.

10. The combination as recited in claim 6, wherein said shelf support pole is hollow.

11. The combination as recited in claim 6, wherein said shelf support pole is solid and each said pair of opposed screw holes comprises a bore connecting said screw holes through said support pole perpendicular to the longitudinal axis thereof.

* * * * *